United States Patent [19]

Carroll

[11] 4,066,397

[45] Jan. 3, 1978

[54] TEXTILE MATERIALS HAVING IMPROVED ELASTICITY AND METHOD FOR PRODUCING SAME

[75] Inventor: Clifford Charles Carroll, Spartanburg, S.C.

[73] Assignee: Milliken Research Corporation, Spartanburg, S.C.

[21] Appl. No.: 735,327

[22] Filed: Oct. 26, 1976

[51] Int. Cl.[2] ..... D06M 13/42; D06M 15/52

[52] U.S. Cl. ..... 8/192; 8/115.5; 8/115.7; 8/DIG. 11; 260/42.53; 260/77.5 A

[58] Field of Search ..... 8/115.5, 115.7, 192, 8/DIG. 11, 77.5 A; 260/42.53

[56] References Cited

U.S. PATENT DOCUMENTS

| | | | |
|---|---|---|---|
| 2,721,811 | 10/1955 | Dacey et al. | 8/DIG. 11 |
| 3,847,543 | 11/1974 | Carroll | 8/127.6 |

FOREIGN PATENT DOCUMENTS

| | | | |
|---|---|---|---|
| 4,539,515 | 12/1970 | Japan | 8/DIG. 11 |
| 4,746,039 | 11/1972 | Japan | 8/DIG. 11 |

*Primary Examiner*—John Kight, III

*Attorney, Agent, or Firm*—Glen M. Burdick; H. William Petry

[57] ABSTRACT

A method for improving the elasticity of a textile material is provided wherein a preshrunk textile material, while maintained in a relaxed state, is impregnated with a liquid admixture consisting essentially of a polyisocyanate, a polyether diol, and a polyether polyol having at least three hydroxyl groups per molecule, reacting the polyisocyanate with the polyether diol and polyether polyol to provide a polymeric impregnated textile material, and curing the polymeric impregnated textile material to provide a textile material having improved elasticity.

22 Claims, No Drawings

TEXTILE MATERIALS HAVING IMPROVED ELASTICITY AND METHOD FOR PRODUCING SAME

This invention relates to textile materials. In one aspect it relates to textile materials having improved elasticity. In another aspect is relates to a method for improving the elasticity of textile materials.

Rubber coated or rubber containing textile materials have heretofore been employed as waistbands, belts, and the like on certain garments. However, the use of such rubber coated or rubber containing textile materials has suffered from the disadvantage in that such were readily attacked by solvents normally used in the drycleaning process. Also, such materials have a tendency, upon aging, to discolor and often become brittle.

Polymeric materials, such as those formed by the reaction of polyisocyanate and polyglycol monomers, have heretofore been employed to treat fabrics and thereby reduce the shrinkage characteristics of such textile materials. Such a process is disclosed in U.S. Pat. No. 3,847,543 wherein aliphatic polyisocyanates are reacted with polyglycols to reduce the shrinkage characteristics of textile materials containing keratin fibers, and synthetic, wool-like fibers such as acrylic fibers.

While numerous new and novel processes for treating textile materials, such as for reducing the shrinkage of certain textile materials as stated above, have been proposed, little or no improvements have been offered as to improving the elasticity properties of textile materials. In improving the elasticity properties of a textile material it would be highly desirable if one could develop a material which possessed the desired elasticity so that such materials could be employed as waistbands, belts, and the like, which would be readily resistant to the solvents employed in drycleaning operations while maintaining the desired resistance to the laundering operation. It is to such a material and method for producing same that the present invention is directed.

According to the present invention I have now discovered a method for improving the elasticity of a textile material which does not suffer from the disadvantages of the prior art compositions and methods for producing same. Broadly, the method comprises impregnating a preshrunk textile material, which is maintained in a relaxed state, with a liquid admixture consisting essentially of a polyisocyanate, a polyether diol, and a polyether polyol having at least 3 hydroxyl groups per molecule, reacting the polyisocyanate with the polyether diol and the polyether polyol to provide a polymeric impregnated textile material, and thereafter curing the polymeric impregnated textile material to provide a textile having improved elasticity.

The textile material employed as the substrate and which is impregnated with the polyisocyanate, polyether diol and polyether polyglycol to produce the textile material having improved elasticity in accordance with the present invention can be any textile material containing natural and/or synthetic fibers. Examples of suitable textile materials are those containing fibers of polyester, nylon, cotton, and mixtures of such synthetic and natural fibers. Especially desirable results can be obtained when the textile material is a nylon textile material.

Once the fabric has been selected and it is determined that it is desirable to improve the elasticity properties of the textile material, the textile material is preshrunk by any suitable method which is well known in the art. The preshrunk material is then maintained in a relaxed state while contacted with the liquid admixture containing the polyisocyanate, the polyether diol and the polyether polyglycol. The term "relaxed state" as used herein is to be understood that the textile material is not placed under stretching or tension during the impregnation of same with the beforementioned admixture of monomers.

The liquid admixture employed to impregnate the preshrunk textile material is a monomer admixture consisting essentially of a polyisocyanate, a polyether diol and polyether polyol having at least 3 hydroxyl groups per molecule. It is essential that if one is to provide the desired product having improved elasticity which is resistant to laundering operations and drycleaning operations that the polyether diol and the polyether polyol having at least 3 hydroxyl groups per molecule be employed in combination with the polyisocyanate monomer. While the amount of such monomer constituents can vary widely, the polyisocyanate should be employed in an amount sufficient to provide an excess of isocyanate groups to hydroxyl groups in the monomer admixture. Generally, the ratio of isocyanate groups to hydroxyl groups should be maintained in a ratio of at least about 1.1:1. Desirable results can be obtained when the amount of polyisocyanate employed in the monomer admixture is that amount sufficient to provide a ratio of isocyanate groups to hydroxyl groups derived from the polyether diol and polyether polyol monomer of from about 1.1:1 to about 4:1.

The polyisocyanates which can be employed in the admixture can be any suitable aryl polyisocyanate or aliphatic polyisocyanate. Because of improved color characteristics, the aliphatic polyisocyanates are preferred. When employing the aliphatic polyisocyanates in the method of the invention such aliphatic polyisocyanates may have saturated or unsaturated aliphatic chains. Advantageously, the aliphatic portions of the molecule are cycloaliphatic, and preferably polycycloaliphatic. Examples of suitable aryl polyisocyanates which can be employed in the practice of the invention are aryl diisocyanates such as a 2,4-toluene diisocyanate, 2,6-toluene diisocyanate, 4,4'-diphenylmethane diisocyanate, p-phenylene diisocyanate, 1,5-naphthylene diisocyanate, m-phenylene diisocyanate, diphenyl-4,4'-diisocyanate, azobenzene-4,4'-diisocyanate, diphenylsulphone-4,4'-diisocyanate, 1-isopropylbenzene-3,5-diisocyanate, 1-methyl-phenylene-4,4'-diisothiocyanate, benzene-1, 2,4-triisothiocyanate, 5-nitro-1,3-phenylene diisocyanate, xylene-1,4-diisocyanate, sylene-1,3-diisocyanate, 4,4'-diphenylenemethane diisocyanate, 4,4'-diphenylenepropane diisocyanate and xylene-1,4-diisothiocyanate and the like; alicyclic diisocyanates, such as dicyclohexamethane-4,4'-diisocyanate and the like; alkylene diisocyanates such as tetramethylene diisocyanate, hexamethylene diisocyanate and the like, as well as mixtures thereof and including the equivalent isothiocyanates. Of these compounds, the aryl diisocyanates are preferred because of their solubility and availability.

Examples of suitable aliphatic polyisocyanates which can be employed in the practice of the invention include dicyclohexylmethane diisocyanate, cyclohexane diisocyanate, hexamethylene diisocyanate, dodecamethylene diisocyanate, tetramethylene diisocyanate, pentamethylene diisocyanate, and the corresponding diisothiocyanates. Additional isocyanates include alkylene diisocyanates and diisothiocyanates such as propylene-1,2 diisocyanate, butylene-1,2 -diisocyanate, butylene-1,3 diisothiocyanate and butylene-1,3 diisocyanate; alkylidene diisocyanates and diisothiocyanates such as ethylidene diisocyanate $CH_3CH(NCO)_2$ and heptylidene diisothiocyanate $CH_3(CH_2)_5CH(CNS)_2$. In addition, mixtures of the various isocyanate compounds may be employed.

As previously stated, it is essential that the polyether diol and the polyether polyol both be present in the liquid admixture. The amount of such monomer constituents can vary widely but will generally be present in a weight ratio of polyether diol to polyether polyol of from about 1:10 to about 10:1, preferably from about 1:1 to about 1:4. The molecular weight of the polyether diol and polyether polyol can vary widely but generally each will have a molecular weight in the range of about 300 to about 12,000, preferably from about 2,000 to about 6,000. Similarly, the polyoxyalkylene portion of the polyether diol and polyether polyol can be varied over a wide range but will generally be in an amount of from about 5% to about 95% of the polyether diol or polyether polyol weight, and preferably from about 10% to about 30%. The polyether polyol monomer having at least 3 hydroxyl groups per molecule is preferably selected from triols or tetrols. The triols may be formed by the addition of polyalkyleneoxy chains to trifunctional compounds such as glycerol, hexanetriol, triisopropanolamine and the like. Suitable tetrols have four polyoxyalkylene chains attached to a tetravalent compound such as pentaerythritol or a diamine, such as ethylenediamine. Especially useful are the polyether diols and polyether polyols in which the polyoxyalkylene chains are polyoxyethylene, polyoxypropylene, or mixtures of such.

As pointed out hereinbefore, the polyisocyanate, polyether diol and polyether polyol are applied to the textile material as a liquid monomer admixture. Such can be applied in a concentrated form, and when required, the monomer admixture can be heated to provide a more fluid liquid monomer admixture. However, generally it is desirable that the liquid admixture be applied in combination with an organic carrier or solvent such as benzene, toluene, xylene and halogenated hydrocarbon solvents such as trichloroethylene, methylene chloride, perchloroethylene, ethylene dichloride, chloroform, and the like. The amount of carrier or solvent employed can vary widely. However, since it is desirable that one produce a fabric containing from about 20 weight percent to about 150 weight percent of the polymeric constituent, and more preferably from about 80 to about 100 weight percent, sufficient monomer must be solublized or dispersed within the solvent or carrier to allow the deposition of the monomers within and on the fabric to provide a polymer impregnated textile containing the polymer in the beforementioned ranges.

The textile material which is treated in accordance with the invention may be in the form of yarns, threads or preferably a textile fabric. The fabric may be woven, knitted or nonwoven in form. Likewise, the particular method of application of the liquid admixture of the beforementioned monomers to the textile material can be achieved by any suitable means, such as spraying, dipping, padding, knife-over-row application and the like. After the liquid admixture of the monomers has been applied to the textile material, such as by padding or dipping, excess liquid can be removed by any suitable means such as nipping or squeezing.

To catalyze the reaction of the polyisocyanate, the polyether diol and the polyether polyglycol it is advantageous to include a catalyst in the liquid admixture. Useful catalysts are organo metallic compounds, e.g., zinc naphthenate, and preferably organo tin compounds including dibutyl tin dilaurate, dibutyl tin diacetate, dilauryl tin diacetate, dibutyl tin maleate, dioctyl tin dichloride, tributyl tin chloride and butyl tin triacetate.

After the desired polymerization has occurred within and on the surface of the textile material the polymeric impregnated textile material is cured for a sufficient period of time and at elevated temperature. The curing temperature of the polymeric fabric can vary widely, but will generally be in the range of from about 220° F to about 350° F, preferably 275° F to 325° F for a period of from about 3 seconds to 2 minutes, preferably from about 10 seconds to 30 seconds.

When desirable, an effective amount of a filler can be incorporated into the liquid admixture to substantially reduce the amount of each monomer constituent required to provide an impregnated fabric containing the beforedescribed amounts of polymer. While the amount filler can vary widely, generally such can be used in an amount up to about 75 weight percent, based upon the total weight of the polymer-filled composition. Especially desirable results can be obtained where the filler is employed in an amount of from about 15 to about 30 weight percent. Any suitable filler can be employed in the method of the present invention provided such filler is inert to the polymerization reaction between the polyisocyanate, the polyether diol and the polyether polyglycol monomers, and such filler is not a skin irritant, is substantially non-abrasive, and can be readily dispersed throughout the liquid monomer admixture. Further, the dispersant should have a controlled chemical content with a minimum of impurities and a uniform and controlled particle size range. Such fillers should, in most instances, have an average particle size of less than about 100 microns and preferably a particle size in the range of from about 0.2 to about 6 microns. Examples of suitable fillers which can be employed are the cellulose derivatives such as wood and cotton fibers, synthetic fibers such as nylon, acrylic fibers, and polyester fibers, silicas such as precipitated $SiO_2$ gel, inorganic flakes and fibers such as mica, asbestos and the like, carbon black, clay, and inorganic salts and oxides such as ammonium phosphate and antimony oxides. Regardless of the particular filler chosen, care should be exercised to insure that prior to incorporation of the filler into the liquid admixture that the filler is in its anhydrous form.

After the polymeric impregnated textile material has been cured, it may be desirable to allow the fabric to age prior to sell or further processing. This aging is believed to be a continuation of the reaction mechanism. The aging period may vary widely but will generally be for a minimum of about 16 hours. The aging period may continue for a number of days but generally an aging period of from about 16 to about 48 hours provides good results for most textile materials.

Textile materials having improved elasticity properties are achieved according to the process of the present invention without sacrificing other desirable properties such as strength, appearance, feel, durability and the like. Also, the method of the invention provides a number of processing advantages in that a textile material can be treated with a simple impregnation process with monomeric materials to provide improved elasticity properties.

In order to further illustrate the invention, the following examples are given. However, it is to be understood that these examples are for illustrative purposes only and are not to be construed as unduly limiting the scope of the present invention.

EXAMPLE 1

PREPARATION OF FABRIC SUBSTRATE

A woven nylon fabric consisting of a textured nylon 66 warp (2 ply/70 denier/13 filaments) and a filling yarn (14 mil type 66 nylon monofilament) was constructed to provide about 10–13 picks/inch. The fabric was then heat shrunk in a forced air oven at 300° – 325° F for 2 to 4 minutes to develop a textured warp, preshrunk fabric having about 23–26 picks/inch. The fabric was maintained in a horizontally relaxed condition during the shrinking step.

POLYMERIC MODIFICATION OF TEXTILE SUBSTRATE

A. A liquid admixture was prepared by admixing the following ingredients in the specified amounts:

50 g of 4,4'-diphenylmethane diisocyanate
90 g of a polyoxypropylene diol having an average molecular weight of about 2,000
145 g of a triol, a glycerol which had been propoxylated to an average molecular weight of about 5,000
0.14 g dibutyl tin dilaurate, a catalyst
285 g trichloroethylene, a liquid solvent Formulation A, which had a ratio of isocyanate groups to hydroxyl groups of 2.25:1, was then padded onto a relaxed sample of the beforedescribed nylon substrate so as to provide a 200% wet pick up by the fabric. The treated fabric was then dried and cured at 315° F for 5 minutes. Thereafter, the dried and cured sample, which contained 100% polymeric add-on, based on the dry weight of the nylon substrate, was allowed to age at room temperature for about 16 hours before testing.

B. A liquid admixture was also prepared by admixing the following ingredients in the specified amounts:

50 g of 4,4'-dicyclohexylmethane diisocyanate
65 g of a polyoxypropylene diol having an average molecular weight of about 2,000
104 g of a triol, a glycerol which had been propoxylated to an average molecular weight of about 5,000
1.1 g dibutyl tin dilaurate, a catalyst
94 g trichloroethylene, a liquid solvent Formulation B, which had a ratio of isocyanate groups to hydroxyl groups of 3:1, was then padded onto a relaxed sample of the beforedescribed nylon substrate so as to provide a 200% wet pick up by the fabric. The treated fabric was then dried and cured at 260° F for 10 minutes. Thereafter, the dried and cured sample, which contained 100% polymer add-on, based on the dry weight of the nylon substrate, was allowed to age at room temperature for about 72 hours before testing.

C. A liquid admixture was prepared by admixing the following ingredients in the specified amounts:

50 g of 4,4'-dicyclohexylmethane diisocyanate
87.5 g of a polyoxypropylene diol having an average molecular weight of about 2,000
137.5 g of a triol, a glycerol which had been propoxylated to an average molecular weight of about 5,000
77 g of precipitated $CaCO_3$, a filler having an average particle size of from about 0.2 to about 6 microns
1.4 g dibutyl tin dilaurate, a catalyst
151 g trichloroethylene, a liquid solvent Formulation C, which had a ratio of isocyanate groups to hydroxyl groups of 2.25:1, was then padded onto a relaxed sample of the beforedescribed nylon substrate so as to provide a 221% wet pickup by the fabric. The treated fabric was then dried and cured at 270° F for 5 minutes. Thereafter, the dried and cured sample, which contained 155% polymer add-on, based on the dry weight of the nylon substrate, was allowed to age at room temperature for about 72 hours before testing.

STRETCH-AND-RECOVERY PROPERTIES OF POLYMERIC MODIFIED FABRIC

Stretch-and-recovery properties of the fabrics modified with Formulations A, B and C in accordance with the procedures set forth hereinbefore were obtained using an Instron machine. Each of the modified fabrics were cut into samples one-inch wide and the samples were extended 70% to "break" or loosen coating prior to testing. A gage length of 5 inches and a full scale load of 10 pounds with a chart speed of 20 inches/minute and a crosshead speed of 5 inches/minute were used to provide the data. The data from such measurements are tabulated below. Data is given for samples, initially, washed three times at 120° F, and drycleaned three times.

TABLE

| | INSTRON: 3 CYCLES | | |
|---|---|---|---|
| Sample | Stretch (%) Cycle-2 | Work Recovery (%) Cycle-2 | Set (%) Cycle 1–3 |
| A | | | |
| Treated | 79 | 74 | 7.1 |
| 3 Washing | 83 | 73 | 7.8 |
| 3 Drycleaning | 91 | 70 | 9.0 |
| B | | | |
| Treated | 63 | 72 | 6.2 |
| 3 Washing | 65 | 71 | 6.5 |
| 3 Drycleaning | 77 | 70 | 7.8 |
| C | | | |
| Treated | 66 | 66 | 6.6 |
| 3 Washing | 69 | 67 | 8.0 |
| 3 Drycleaning | 74 | 67 | 9.2 |
| Rubber Fabric | | | |
| Treated | 140 | 62 | 18.0 |
| 3 Washing | 144 | 62 | 21.6 |
| 3 Drycleaning | 168 | 60 | 25.8 |

The above data clearly indicates the improved elasticity properties of the polymeric modified textile materials of the present invention, especially when employing preshrunk nylon textile materials as the textile substrate.

Having thus described the invention, I claim:

1. A method for improving the elasticity of a textile material which comprises impregnating a preshrunk textile material maintained in a relaxed state with a liquid admixture consisting essentially of a polyisocyanate, a polyether diol and a polyether polyol having at least three hydroxyl groups per molecule, said polyether diol and polyether polyol each having a molecular weight of from about 300 to about 12,000 and said polyisocyanate being present in said admixture in an amount sufficient to provide a ratio of isocyanate groups to hydroxyl groups in said admixture of at least about 1.1:1, reacting said polyisocyanate with said polyether diol and polyether polyol to provide a polymeric impregnated textile material and curing said polymeric impregnated textile material.

2. The polymeric impregnated textile material of claim 1.

3. The process according to claim 1 wherein said curing of said polymeric impregnated textile material is carried out at a temperature of from about 220° F to about 350° F.

4. The process according to claim 3 wherein the amount of polyisocyanate employed in said admixture is an amount sufficient to provide a ratio of isocyanate groups to hydroxyl groups of from about 1.1:1 to about 4:1.

5. The process according to claim 4 wherein the reaction is conducted in the presence of a catalyst.

6. The process according to claim 5 wherein said catalyst is an organo metallic compound.

7. The process according to claim 6 wherein said catalyst is an organo tin compound.

8. The process according to claim 4 which includes the step of aging the cured polymeric textile material for at least about 16 hours prior to use of said material.

9. The polymeric impregnated textile material of claim 8.

10. The process according to claim 4 wherein said polyisocyanate is an aliphatic polyisocyanate.

11. The process according to claim 10 wherein said aliphatic polyisocyanate is a polycycloaliphatic polyisocyanate.

12. The process according to claim 11 wherein said polyether diol and said polyether polyol are present in said admixture in a weight ratio of from about 1:10 to about 10:1.

13. The process according to claim 12 wherein said polyether diol and said polyether polyol are present in a weight ratio of from about 1:1 to about 1:4, respectively.

14. The polymeric impregnated textile material of claim 13.

15. The process according to claim 13 wherein said polyether diol is a polyethyleneoxy diol or polypropyleneoxy diol having a molecular weight of from about 2,000 to 6,000.

16. The process according to claim 15 wherein said polyether polyol is a polyethyleneoxy triol or polypropylene triol having a molecular weight of from about 2,000 to 6,000.

17. The process according to claim 16 wherein said polyisocyanate is diphenylmethane diisocyanate and said polyether diol is a polypropyleneoxy diol having an average molecular weight of about 2,000 and said polyether polyol is polypropyleneoxy triol having an average molecular weight of about 5,000.

18. The polymeric impregnated textile material of claim 17.

19. The process according to claim 1 wherein said liquid admixture includes an organic solvent.

20. The process according to claim 19 which includes incorporating up to about 75 weight percent, based on the weight of said admixture, of an inert filler material having an average particle size of up to about 100 microns.

21. The process according to claim 20 wherein said filler material is employed in an amount of from about 15 to about 30 weight percent and said filler material has an average particle size of from about 0.2 to about 6 microns.

22. The polymeric impregnated textile material of claim 21.

* * * * *

UNITED STATES PATENT OFFICE
CERTIFICATE OF CORRECTION

Patent No. 4,066,397 Dated January 3, 1978

Inventor(s) Clifford Charles Carroll

It is certified that error appears in the above-identified patent and that said Letters Patent are hereby corrected as shown below:

Column 1, line 53, after "textile" insert --material--.

Column 4, line 22, after "amount" insert --of--.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*